United States Patent [19]

Wallace et al.

[11] Patent Number: 4,567,656

[45] Date of Patent: Feb. 4, 1986

[54] SHEARS, SCISSORS, AND OTHER HAND TOOLS

[75] Inventors: Edward M. Wallace, Longmeadow; Robert G. Gosselin, Springfield, both of Mass.

[73] Assignee: Wallace Mfg. Corp., Enfield, Conn.

[21] Appl. No.: 611,900

[22] Filed: May 18, 1984

[51] Int. Cl.[4] ..... B26B 13/00

[52] U.S. Cl. ..... 30/262

[58] Field of Search ..... 30/254, 260, 262, 193; 81/321, 324

[56] References Cited

U.S. PATENT DOCUMENTS

| | | | |
|---|---|---|---|
| 2,369,271 | 2/1945 | Arnold | 30/260 |
| 2,396,583 | 3/1946 | Lenk et al. | 30/262 |
| 3,416,226 | 12/1968 | Pfaffenbach | 30/262 X |

*Primary Examiner*—Douglas D. Watts

*Attorney, Agent, or Firm*—Ross, Ross & Flavin

[57] ABSTRACT

A hand tool of the scissors type includes two pivotally-movable operating members or jaws or blades and two pivotally-movable handle members which members are readily separable from each other and are interrelated by a single pivot bolt extendable through the four components so that relative movement between each operating member and its respective handle member is precluded. The components are readily replaceable without supporting rivets, pins, screws or the like. Novel locking means allow easy tool operation both in the opening stroke preparatory for use and in the closing operating stroke and for assuming the safe locked position when the tool is fully closed.

9 Claims, 18 Drawing Figures

SHEARS, SCISSORS, AND OTHER HAND TOOLS

BACKGROUND OF THE INVENTION

1. Field of the Invention

Our invention has to do with shears, scissors and other hand tools of the general type including a pair of pivotally movable operating members, such as a blade and hook or a pair of jaws or blades, movable relative to each other, and a pair of pivotally movable handles associated with respective operating members by means of a single pivot arrangement extendable through strategically-aligned openings in both the operating and handle members. In each case, the operating member and respective handle member are internested so as to preclude relative movement therebetween once the components are assembled in the tool and made ready for operational use. The operating members are swingable away from each other in the usual opening stroke manner preparatory for use and toward each other in the usual closing stroke manner as the operating or severing function is served and/or as a safe locked storage position is assumed when the tool has been fully closed and operational use concluded.

The operating members are swingable relatively toward each other by the manually engageable handles in the jaw closing other by the manually engageable handles in the jaw closing stroke and in opposition to the return force of a spring means which normally biases the members apart in a jaw opening stroke.

Tools envisioned as coming within the scope of this disclosure will include scissors, scissor-like tools useful for various purposes within the household or elsewhere, and garden tools including shears, pruners, trimmers and the like, different operating components being readily called into play for the accomplishment of various field functions, additional to cutting vegetation, such as metal cutting, wire cutting, small bolt cutting, etc.

The salient value in the tool of this design is that the operating components are readily replaceable, making same particularly practical when in the field and a jaw or blade becomes broken or dulled. In such instance, the defective component can be easily replaced, tool disassembly and reassembly being easily achievable by the use of something as simple and as innocent as a mere coin, paper clip or the llke for engaging and rotating the bolt head of the assembiy.

2. Description of the Prior Art

As many of the prior art constructions as are commercially available in the local markets were procured, studied and evaluated and were noted to have all or some of these shortcomings.

These constructions frequently employed handle extensions for the purpose of securing the blades or jaws, usually by the bolting or riveting of the parts together. Such extensions interfere with tool operation, particularly when the work being operated upon is placed near the pivot area, i.e. the high leverage area affording maximum leverage, and obviously the most important operating area. Significantly, the tool of the invention is without handle extensions.

These prior art constructions also use in some cases blade or jaw extensions or tangs which either are permanently affixed to the handles or lie deep within provided recesses in the handles. Permanent securement obviously does not allow for ready blade or jaw replacement and extensions into handle wells or recesses adds to obvious manufacturing costs and assembling complications. Blade or jaw extensions are absent in the tool of the invention.

These constructions usually dictate the employment of blade or jaw screws or rivets or pins for interconnecting the blades or jaws to their respective handles, obviously adding to tool costs and, worse, frequently requiring the use of special tools for the disassemble and assemble functions and to make blade or jaw replacement in the field difficult if not impossible. The tool of the invention requires no supplemental connecting means in the form of screws or rivets for attaching blades or jaws to handles, something as simple as a coin serving for tool disassembly and reassembly when blade or jaw replacement is dictated.

These prior art constructions often employ an exposed spring which can be easily removed or lost when the tool is on sale or in use. The spring means of the tool of the invention is cleverly concealed, lying safely and securely within the inner confines of what we will identify as the critical pivot area.

Too, these constructions often feature lock mechanisms which are complicated in design and may even require the use of the operator's two hands. The tool of the invention features a lock which can be easily manipulated by the operator's one hand, the hand which holds the shear.

SUMMARY OF THE INVENTION

A primary identifying characteristic of the tool as well as a new and novel feature thereof distinguishing it from the known prior art is that the tool components may be readily disassembled and replaced and reassembled by something as simple as a coin engaged in the slot of the bolt head.

Further distinguishing the tool is the fact that the operating members or blades or jaws or whatever they may be called in any particular application are each readily held in situ in appropriate seats in their respective handle members without supporting rivets or pins or screws or the like, the single through bolt and its cooperant nut serving to maintain the tool integrity upon assembly.

Salient features are also found in the locking system. The lock means is seated in a recess within a housing having exterior wall surfaces which serve to define a locating means for positioning one of the blades relative to its respective handle, thereby facilitating blade replacement in the field. The lock per se is provided with projecting ears which, by their position with respect to the recess readily serve to offer the user an indication of direction of lock rotation to be effected for the shear opening or shear closing stroke. And the ears also limit the extent of that lock rotation by virtue of abutment against opposite recess walls.

As another feature, a spring means is guided in expanding and contracting movements by virtue of being seated within a through spring slot in one of the operating members, there being an outwardly proJecting pin extending from the other operating member and into the spring slot when the operating members are brought into confrontation upon assembly. In the assembled arrangement, as the two handles are moved in jaw closing direction, the pin is caused to move along the slot thereby to deform or compress the spring means with a resultant increase in the force thereof. The two handle members are moved reversely in jaw opening direction by virtue of the spring means expansion. That portion of the slot through which the pin travels is preferentially arcuate with reference to the pivot axis about which it is formed.

One key advantage of the spring system hereof is that it is entrapped and fully concealed so that it won't be lost while the tool is on display for sale purposes or is in use.

Most significantly in this arrangement is that the blade stop, for limiting the shear opening stroke, and the spring means serving the shear opening function, and the lock means for facilitating shear closing at the end of the shear closing stroke, all lie within the confines of provided jaw tangs in a simple, inexpensive and effective tool.

The invention is capable of receiving a variety of mechanical expressions, one of which is shown on the accompanying drawings as exemplary, but it is to be expressly understood that the drawings are for the purpose of illustration only and are not to be construed as definition of the limits of the invention.

DESCRIPTION OF ONE EMBODIMENT OF THE INVENTION

Figure 3:
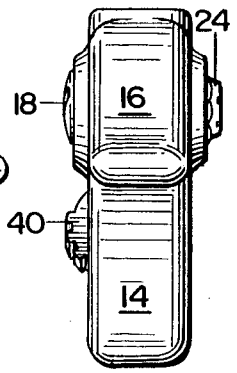
FIG. 3 is a view in end elevation taken from the so-called rear or handle end of the tool.

In the following description and in the appended claims, various components and details thereof will be identified by specific names for purposes of convenience. The phraseology or terminology herein employed is not for the purpose of limitation and is intended to be as generic in its application as the art will permit. We have shown a garden pruner merely for purposes of exemplification.

The pruner is shown as comprising two operating members, or an upper blade or jaw 10 and a lower hook or jaw 12, and two handle members, lower handle 14 and upper handle 16, the operating and handle members being interconnected by a pivot bolt 18 extendable through strategically-located and aligned openings 20 in the operating and handle members with a pivot nut 24 being threadedly engageable therewith on the opposite side of the assemblage for securing the operating and handle members in their pivoting relations.

Suitable washer and bushing 26 and 28 respectively will serve the usual functions of ensuring close fitting and smooth working relations between the operating and handle members.

Bushing 28 is preferentially of the oil impregnated type so as to provide lubrication on demand as friction may develop.

Operating member 10 is shown in the form of an upper cutting blade and operating member 12 is shown in the form of a lower hook, a type common to pruners, but it is to be stressed that the operating members may take other forms for other specific functions peculiar to scissors, scissor-like household tools, garden shears or trimmers, factory tools or the like, as the case may be. The particular types of operating members employed are not of primary importance or significance.

Figure 2:
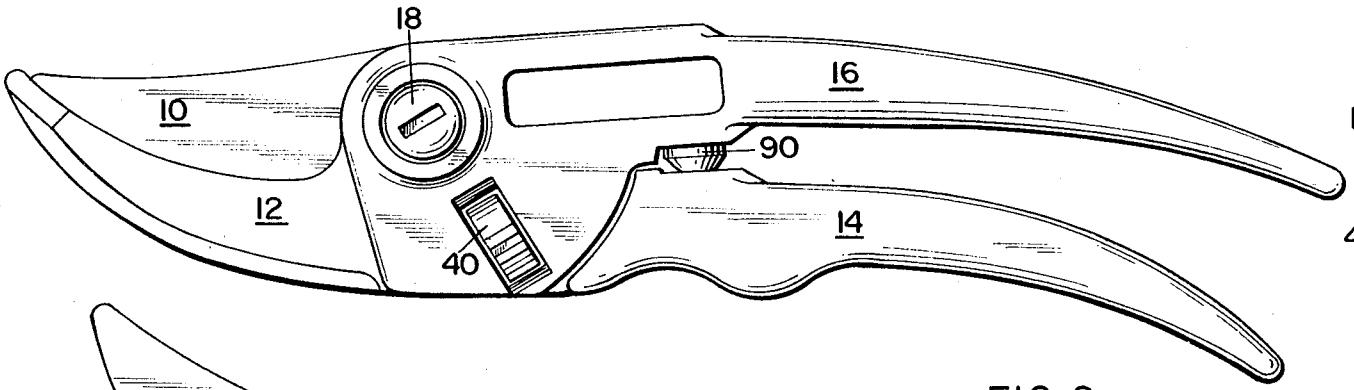
FIG. 2 is a view in side elevation similar to FIG. 1 but showing the tool in the fully-closed position.
Figure 1:
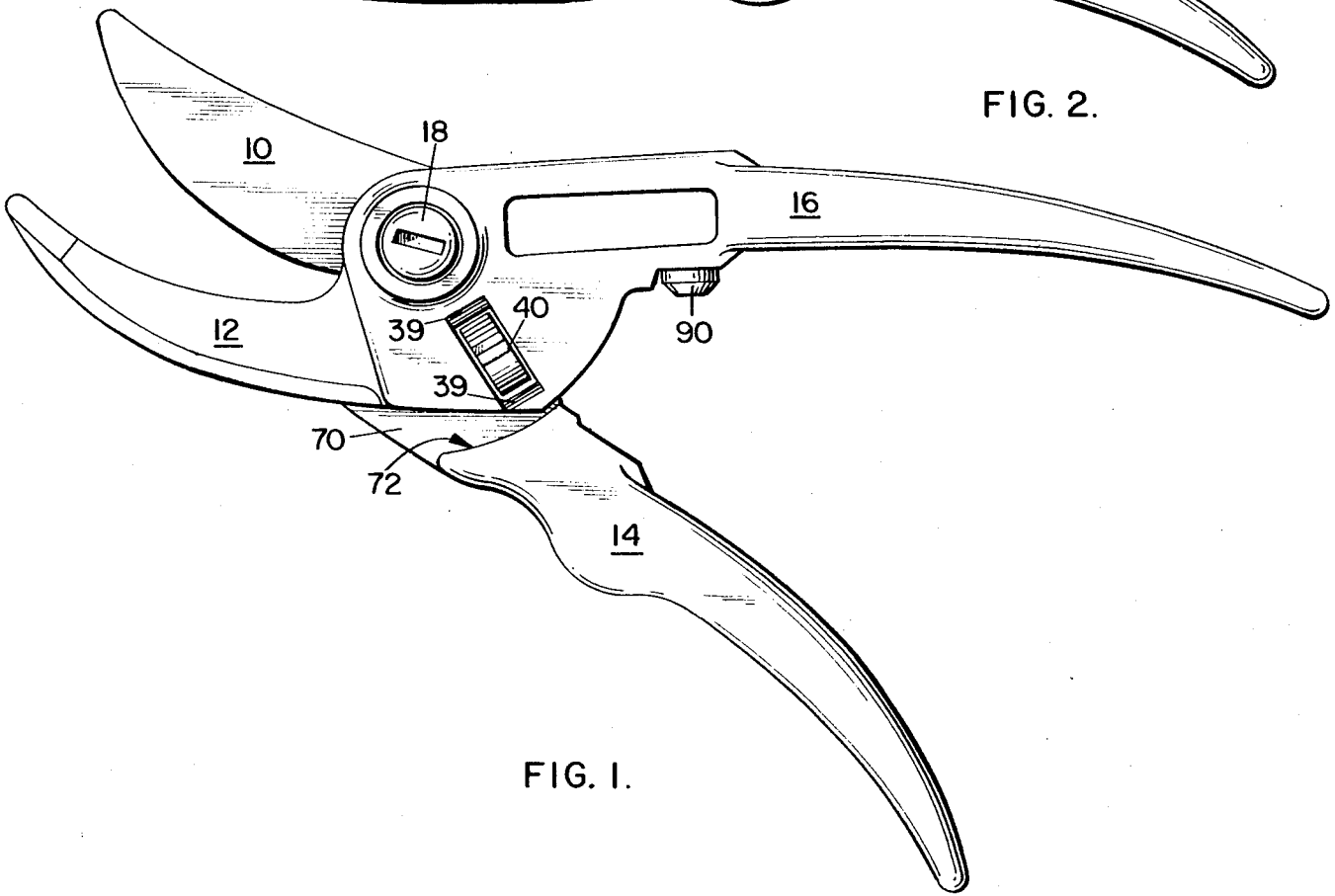
FIG. 1 is a view in side elevation of the left hand side of the tool showing same in the fully-opened position.
Figure 6:
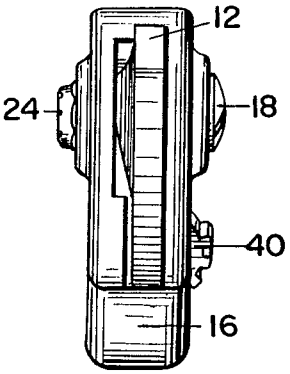
FIG. 6 is a view in end elevation taken from the so-called front or working end of the tool.
Figure 5:
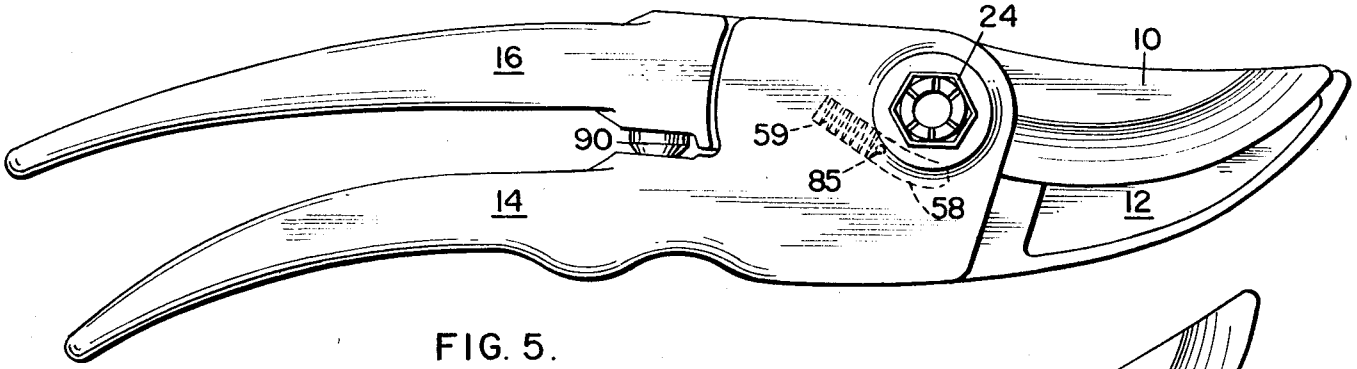
FIG. 5 is a view in side elevation similar to FIG. 4 but showing the tool in the fully-closed FIG. 2 position and showing in phantom the spring in the compressed position in the provided spring slot and the pin serving as the means for compressing the spring as the tool is moved to the fully-closed position.
Figure 4:
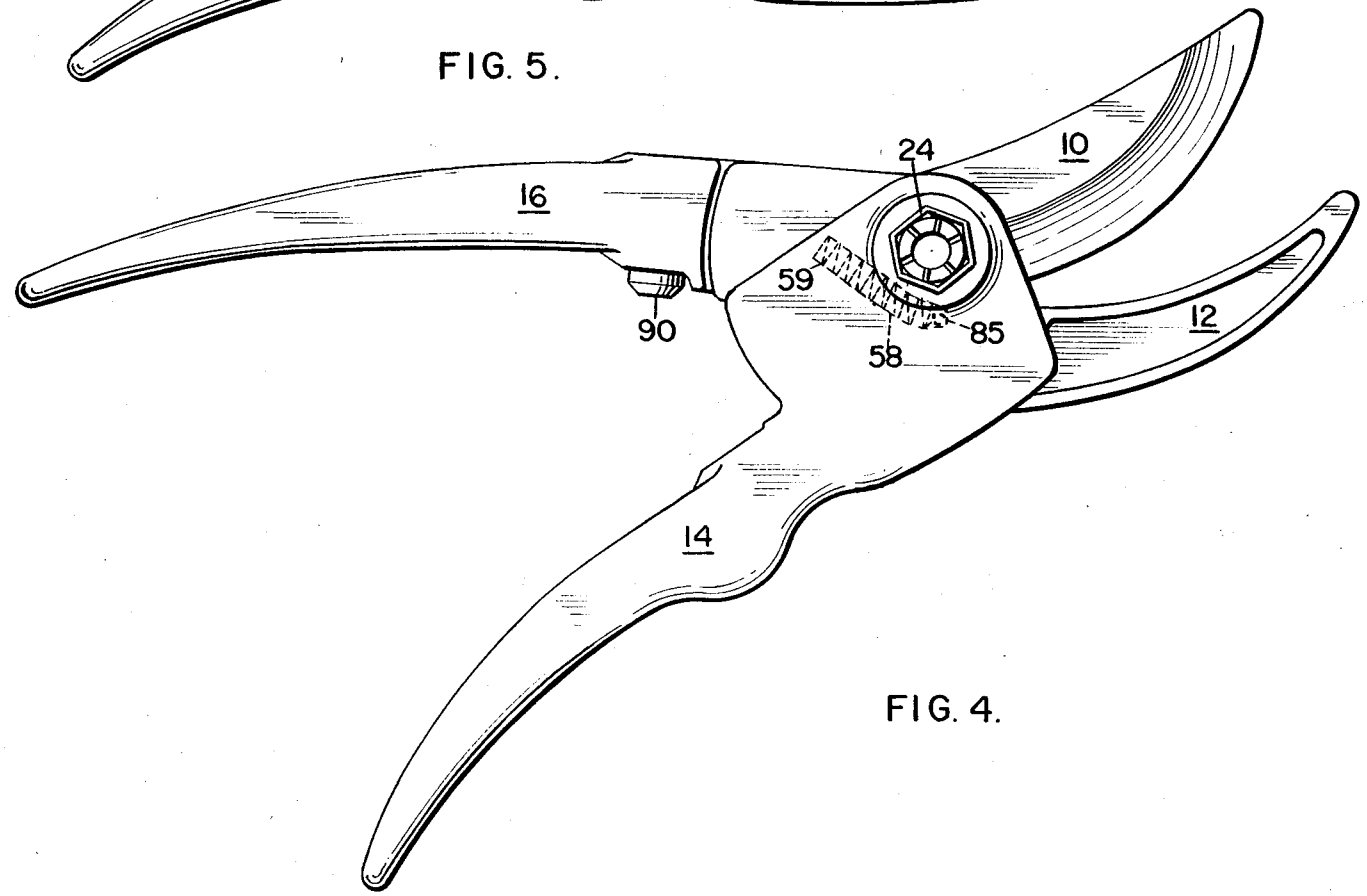
FIG. 4 is a view in side elevation of the right hand side of the tool showing same in the fully-opened FIG. 1 position and showing in phantom the spring in the fully extended position in the provided spring slot and the pin serving as a stop for limiting the extent of the tool opening in the fully-opened position.

Suffice to say that the two operating members and the two handle members, are separable members and, when assembled, are brought into confrontation with each other arranged upon the pivot bolt in order, reading from left side, FIGS. 1 and 2, to right side, FIGS. 4 and 5, as follows: upper handle 16, lower hook or jaw 12, upper blade or jaw 10, and lower handle 14. That is an operating member is not fixed to its respective handle member, or vice versa; they are separable or individualized components.

Figure 11:
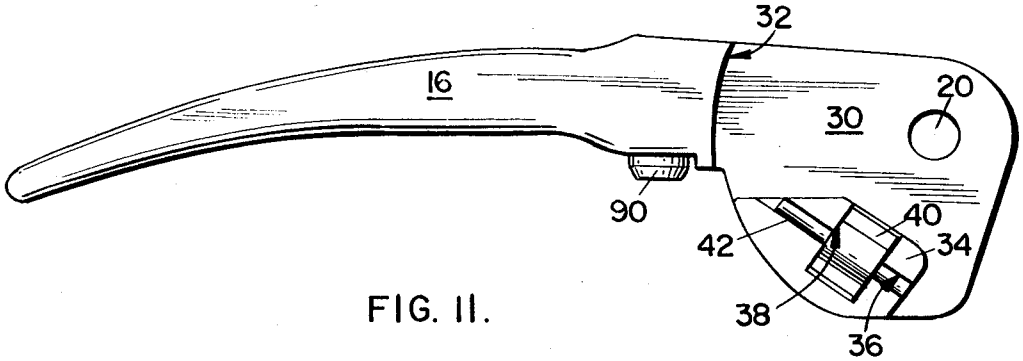
FIG. 11 is a side elevational view showing the inboard face of the upper handle.

Upper handle 16 is provided at its inner end with a relatively thin shank 30 offset with reference to or at one side of the main longitudinal axis thereof so as to define a slightly arcuate shoulder 32 between the handle proper and the offset shank. See FIGS. 7 and 11.

On the inboard face or cheek of shank 30 is an upstanding or raised lock housing 34 at one side edge of said face. The lock housing is bifurcated at 36 with a lock pin slot extendable from end to end of the lock housing. At 38 a through recess, perpendicularly related to and intersecting lock pin slot 36 centrally thereof extends through the lock housing as well as shank 30.

A rotary lock 40, generally cylindrical in configuration, is receivable in recess 38 and a lock pin 42 is extendable through and outboard of the lock on opposite sides thereof, which lock pin is snugly receivable in pin slot 36 so as to allow lock rotation. Once in situ, peening may ensure the securement of the lock pin on its lock pin slot. The lock, it will be noted, is rotatable through an arc about an axis disposed perpendicular to the axis of the pivot bolt.

Figure 16:
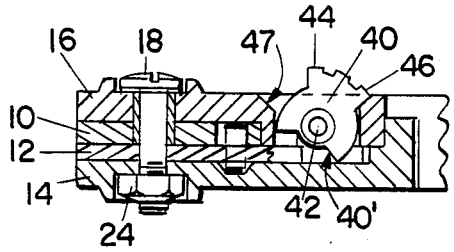
FIG. 16 is a sectional view on the line 16—16 of FIG.15 showing the lock in lock-closed position.
Figure 17:
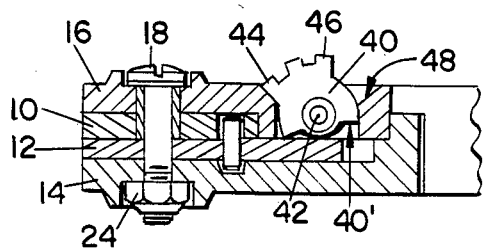
FIG. 17 is a sectional view on the line 17—17 of FIG. 14 showing the lock in lock-opened position.
Figure 18:
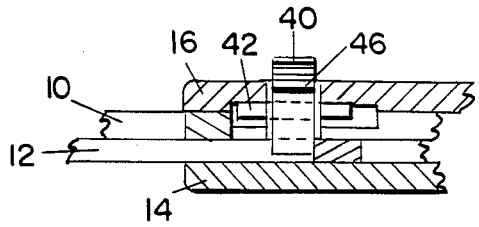
FIG. 18 is a sectional view on the line 18—18 of FIG. 15.

The limits of the rotative arc are determined by a pair of spaced radially arranged ears or detents (an unlocking ear 44 and a locking ear 46), best illustrated in FIGS. 16 and 17. The ears extend radially outwardly from the curved surface of the lock and are of such dimension as to project outwardly of the outside face of shank 30 of upper handle 16 so as to allow ready lock manipulation by the user.

Through recess 38 in upper handle 16 is provided with oppositely disposed bevels on opposite ends of the recess, an unlocking bevel 47 and a locking bevel 48 (see FIGS. 16 and 17). Each bevel provides a bearing surface for the complemental ear or detent, ear 44 bearing upon bevel 47 when the tool is in the moving or unlocked position, and ear 46 bearing upon bevel 48 when the tool is in fully locked position.

The locking is thus so manipulatable when the pruner is closed by a finger of the hand of the operator by which he also holds the two handles of the tool.

The ears or detents offer the obvious advantage that by merely visually observing same, or even by feeling same through the operator's finger, he is afforded a clear indication as to which way to rotate his lock to open or close the tool.

Operating member or lower hook 12 is configured with a tang 50 having a slightly arcuate end face 52 which, on assembly, will lie disposed adjacent the conforming arcuate shoulder 32 of upper handle 16 offering the first of a pair of self-seating features in the mating components.

Figure 13:
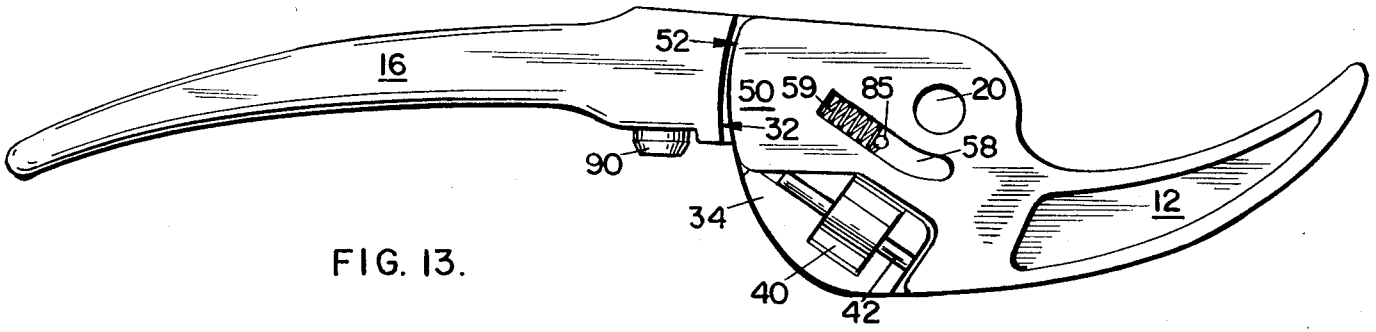
FIG. 13 is a side elevational view showing the inboard faces of the components of FIGS. 11 and 12 in their superposed assembled positions relative to each other and showing the spring in its fully closed position as compressed by the pin.

A second self-seating feature is provided in the form of an inset 56 extending inwardly from one side of the hook to permit the snug interfitting of the hook around complementally configured portions of the side wall of lock housing 34. See FIG. 13. The lock housing thus serves a double function, it houses the lock and it positions the jaw relative to its handle without the need for rivets or the like and the jaw is readily replaceable without the use of rivets or screws or extended tangs.

Figure 12:
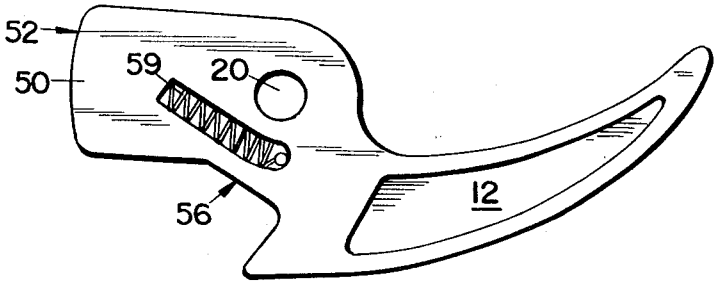
FIG. 12 is a side elevational view showing the inboard face of the hook associated with the upper handle and also showing the relationship of the spring and pin means in the provided hook slot with the spring in the fully extended position and the pin abutting the end of the slot and providing a stop for the tool in the fully opened position.

Additionally, hook 12 is provided with a through spring slot 58 having a slightly arcuate configuration formed about pivot bolt aperture 20. Into this spring slot, a helical spring 59 is nestably received with one end of the spring abutting one end of the spring slot and with the other end thereof abutting against a pin 85 (see FIGS. 12 and 13) subsequently to be referred to.

Figure 7:
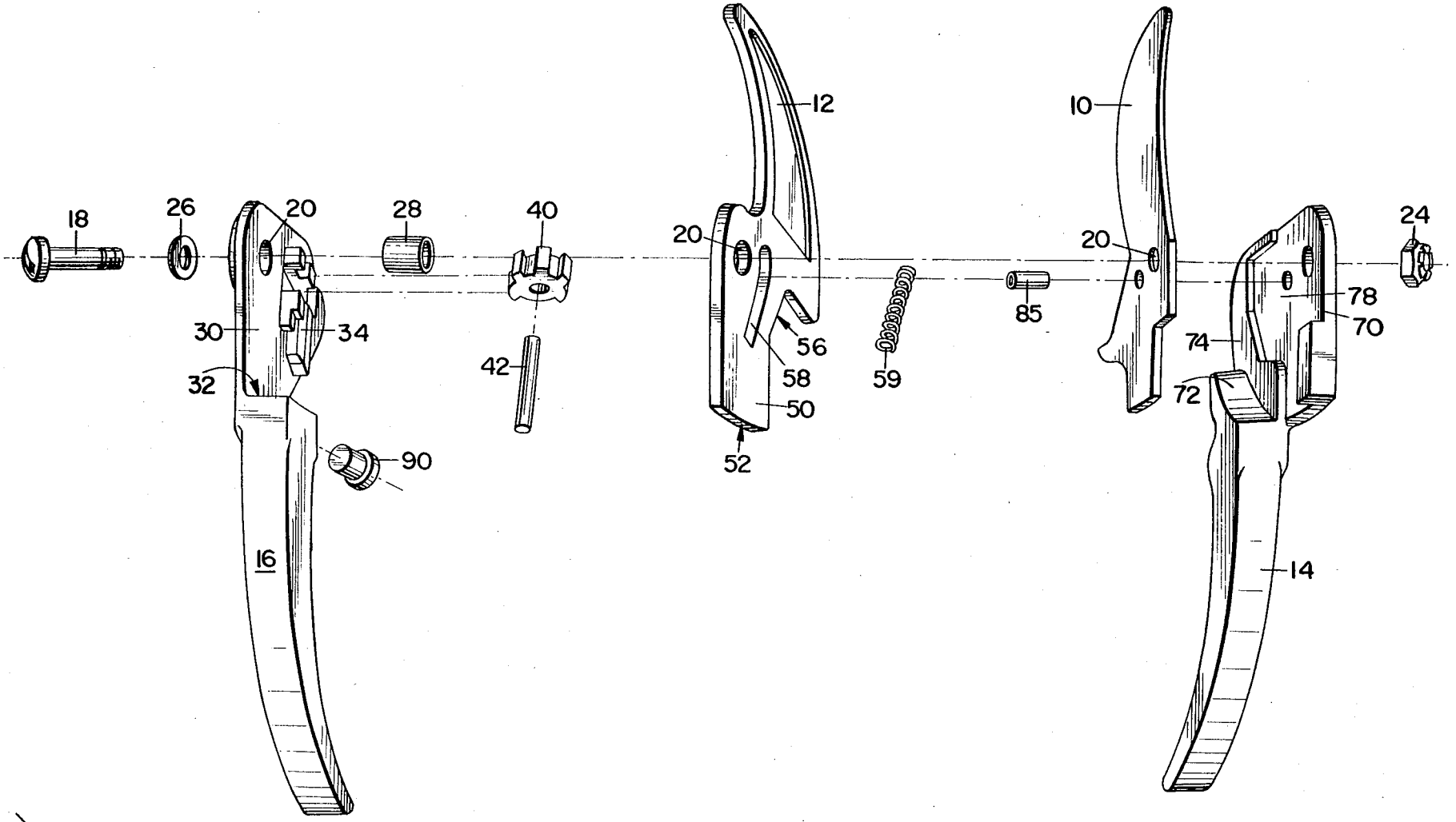
FIG. 7 is an exploded view in perspective showing the various tool components.
Figure 8:
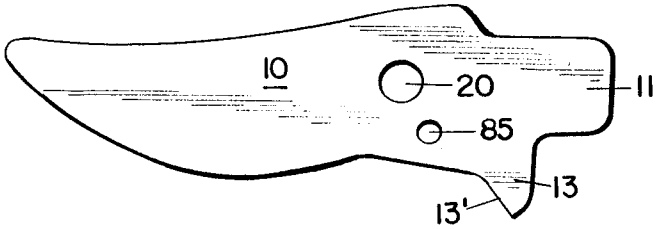
FIGS. 8 and 9 are side elevational views showing the inboard faces of the cutting blade and associated lower handle respectively of the tool.
Figure 9:
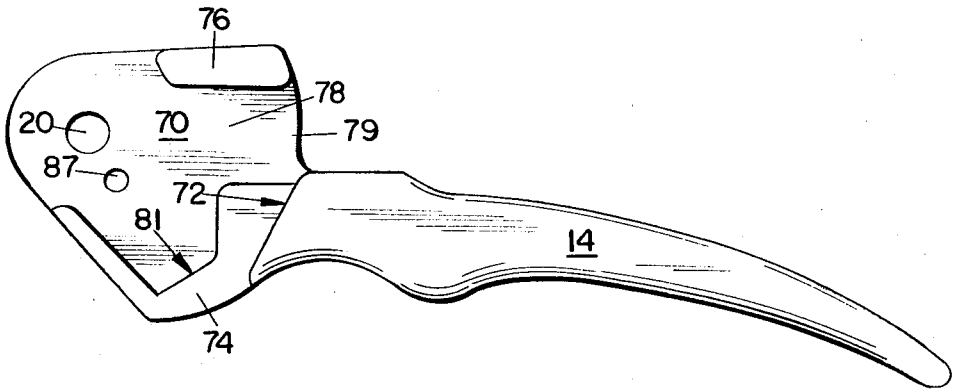

As shown in FIGS. 7 and 9, lower handle 14 is provided at its inner end with a relatively thin shank 70 offset with reference to its main longitudinal axis so as to define a slightly arcuate shoulder or wall 72. Shank 70 is further provided on its inboard face with opposed raised shoulders 74 and 76 on opposite sides thereof so as to define therebetween a well 78 into which one end of upper blade or jaw 10 may be nested with a tang 11 thereof being snugly receivable in a valley 79 of well 78 between shoulders 74 and 76 and with a tang 13 thereof being snugly receivable in a provided inset 81 in raised shoulder 76 so that any relative movement of the two components, lower handle 14 and upper blade 10, upon tool assembly, is precluded. Thus valley 79 and inset 81 serve as locating means for tangs 11 and 13 respectively so that the upper blade can only be positioned in one position relative to the lower handle.

Figure 10:
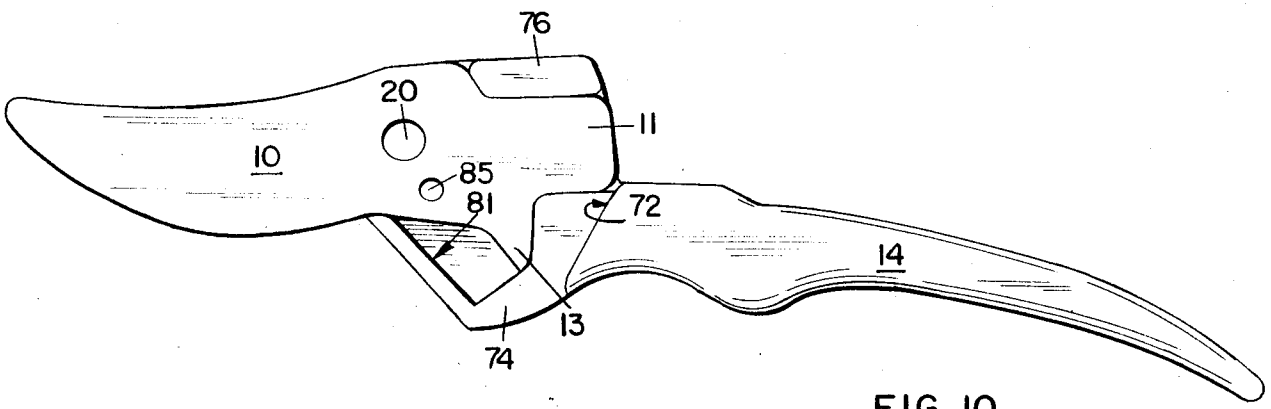
FIG. 10 is a side elevational view showing the inboard faces of the components of FIGS. 8 and 9 in their superposed assembled positions relative to each other.

A self-seating feature of upper blade or jaw 10 with respect to lower handle 14 is provided in the form of the raised shoulders 74, 76 which the upper blade fits between. See FIG. 10.

When the operating members and handles are fully assembled, raised shoulder 76 of lower handle 14 will be observed to provide the resistance for nesting the blade in position and the opposite raised shoulder 74 serves as the locking means.

It is to be stressed that the operating members or blades or jaws 10 and 12 are each readily held in situ in appropriate seats in their respective handle members formed by the respective offset shanks, all without the need for supporting rivets or pins or screws, the single pivot bolt 18 and its cooperant nut 24 serving to maintain the tool integrity upon assembly.

Pin 85, earlier referred to, is fixed to and projects outwardly from operating member 10 in the form of extensions on opposite sides thereof.

One extension of the pin at one side of operating member 10 is receivable in a provided recess 87 in the shank 70 of lower handle 14 and the opposite extension is receivable in spring slot 58.

The spring is guided in expanding and contracting movements by virtue of being seated within the spring slot. In the assembled arrangement, as the two members are moved in jaw closing direction, pin 85 is caused to move along the spring slot thereby to compress the spring, with a resultant increase in the force thereof. The two handles are moved reversely in jaw opening direction by virtue of the spring expansion. In this movement, pin 85 serves as a stop for the jaw opening movement when it abuts the end of the spring slot. See FIG. 12.

The spring, on tool assembly, will be seen to be retained therein on the opposite slot sides by virtue of the confronting cheek of shank 30 of the upper handle on one side of the slot and the confronting upper blade or jaw 10 on the opposite side of the slot. The spring thus has the advantage that it is completely entrapped and concealed so as to prevent same from being lost and yet, in actuality, to allow its ready replacement when the components are disassembled.

When operating members 10 and 12 and handles 14 and 16 are assembled relative to each other by means of pivot bolt 18 extended through the aligned pivot bolt apertures 20 thereof, the movement of the handles toward one another and in opposition to the return force of spring 59 deforms the spring and increases the return force thereof. That is, the spring is so associated with the upper blade or jaw 10 that an increase in the force of the spring occurs in response to the relative movement of the handles toward each other and allowing a return force for opening the tool when the closing pressure is released and the handles are biased apart.

When the tool is brought to closed position, the lock can be easily rotated so that the ear is brought to bear against its complemental bevel wherefor the handles may be locked in the closed position, the lock holding the operating members in the closed position against the return force of the spring which, on release of the lock, will serve to urge the operating members apart.

The ears limit the extent of lock rotation by virtue of the abutment of one ear against its complemental bevel in the tool closing stroke and of the other ear against its complemental bevel in the tool operating stroke.

The ears or detents offer the user the added advantage in the form of an indication of the rotative direction to bring the shear from locked position.

Figure 14:
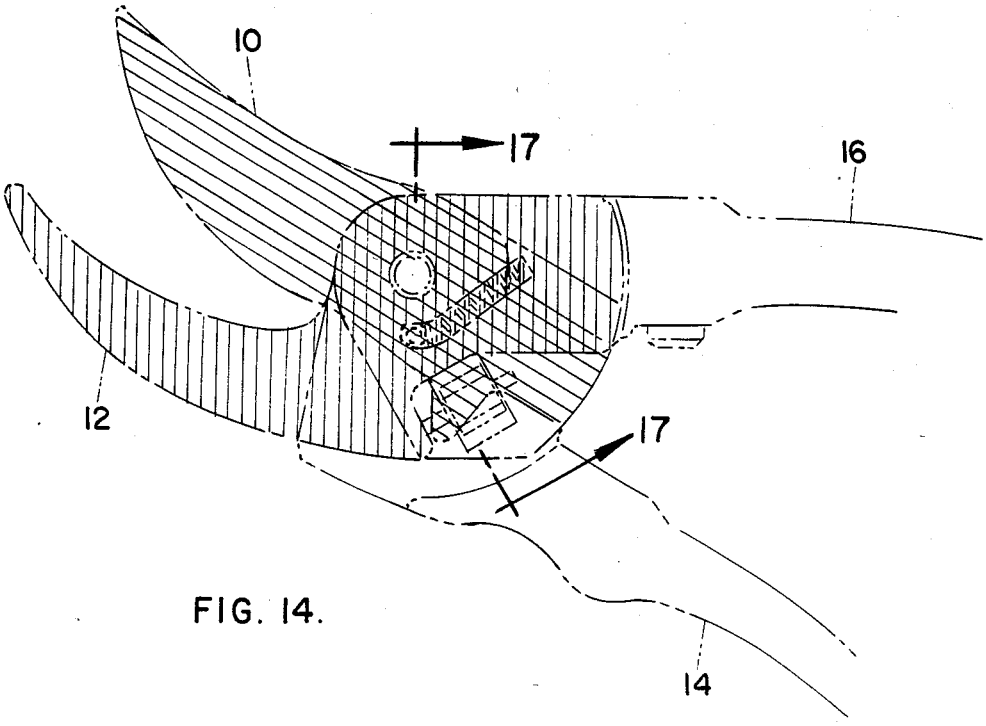
FIG. 14 is a fragmentary view of the tool showing the various components in overlapping position when assembled, the same being shown in the fully-opened position.
Figure 15:
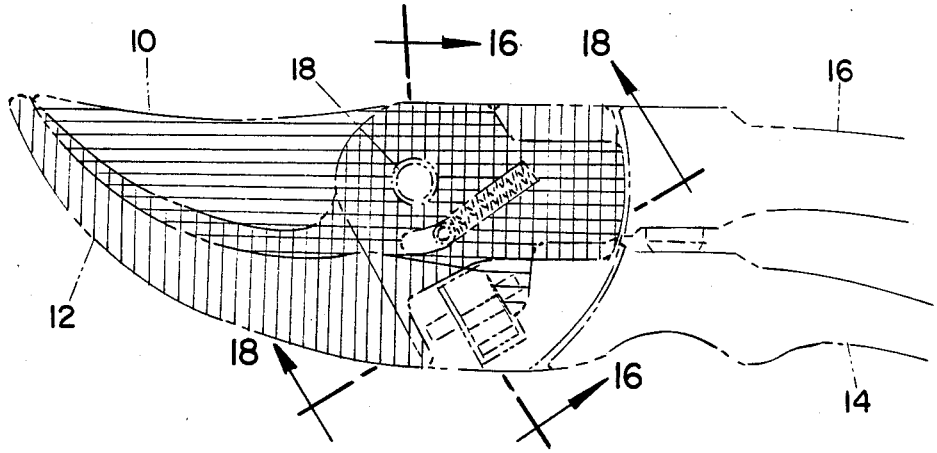
FIG. 15 is a fragmentary view of the tool showing the various components in overlapping position when assembled, the same being shown in the fully-closed position.

The most significant feature of the tool can best be appreciated by the views of FIGS. 14 and 15 wherein all parts of the assembled tool are shown in phantom, in the FIG. 14 "tool open" and FIG. 15 "tool closed" modes in an effort to keep the showings simple and the understanding thereof easier to appreciate.

With the tool open (FIG. 14), tang 13 of upper blade 10 will be seen to be disposed in overlapping relation to lock 40 wherefor the lock may not be manipulated into its locking mode with ear 46 bearing against bevel 48. That is, ear 46 cannot be rotated to bear against bevel 48. While in the open position, the tool cannot be locked.

Contrariwise, with the tool closed (FIG. 15) tang 13 of upper blade 10 will be seen to be disposed in a position clear of lock 40 yet with a side face 13' of tang 13 bearing against a side face 40' of lock 40 wherefor the lock may be manipulated into its locking mode with ear 46 bearing against bevel 48.

A bumper 90 is located on upper handle 16 and acts as a shock absorber, being preferably of a resilient material for augmenting the shock absorbing characteristic.

The bumper serves as a stop means in the tool closed position whereas, conversely, pin 85 bearing against the end of its accommodating spring slot 58 serves as the stop means in the tool opened position.

What we define as the greater pivotal area is that area which lies in a half circle rearwardly of and concentric with the pivot bolt and of a radius sufficient to include the tangs of the blades or jaws and is enclosed by the handle shanks save for the lock portion which projects outboard of the shank of the upper handle. In the case of the exemplified pruner, the radius from the pivot axis approximates $1\frac{1}{2}''$.

The jaws are fixedly located with respect to their handles within the pivotal area which also includes the pivot, the handle biasing spring, the stop means for limiting movement in the tool opening mode, and the lock housing.

We claim:

1. In a hand tool of the pivoted scissors type comprising:

a pair of jaws each provided with a through pivot opening, a pair of handles each provided with a through pivot opening, a lock housing projecting inwardly from the inboard face of one of the handles and defining a locating means for the nesting of a respective jaw relative to the said one of the handles with the through openings being coaxially aligned, a pair of spaced shoulders projecing inwardly from the inboard face of the other one of the handles and defining a locating means for the nesting of a respective jaw relative to the said other one of the handles with the through openings being coaxially aligned, a pivot means extendable through the alignable pivot openings of the jaws and handles of the pairs thereof with the inboard faces of one jaw and respective handle being in confrontation with the inboard faces of the other jaw and respective handle for holding the jaws and handles in interlocked relation and facilitating movement of the jaws toward each other responsively to the actuation of the handles toward each other in an operating mode, a spring means located in an arc disposed circumadjacent the pivot means normally biasing the handles apart in a non-operating mode, the lock housing and respective one of the handles having aligned through-lock-openings, the lock housing having coaxial slots on opposite sides of the through-lock-opening, a lock receivable in the through-lock-openings of the lock housing and respective one of the handles, and a lock pin extendable through the lock and having opposite ends journalled in the coaxial slots for the rotative mounting of the lock about the axis of the coaxial slots and relative to the through-lock-openings of the lock housing and respective one of the handles.

2. In the hand tool of claim 1, the through opening of the respective one of the handles having opposite detent engaging walls, the lock having spaced detents selectively confrontable with opposite detent engaging walls for limiting lock rotation and facilitating tool locking in the non-operating mode.

3. In the hand tool of claim 1, the lock being rotatable in a plane right angularly related to the longitudinal axis of the pivot means.

4. In a hand tool including a pair of operating members each provided with a through pivot opening, a pair of handles each provided with a through pivot opening, one operating member of the pair thereof being related to and cooperating with one handle of the pair thereof, a lock housing integral with one of the handles and projecting inwardly from the inboard face thereof and defining a locating means for the nestable positioning of a respective operating member relative to the said one of the handles, a pair of spaced shoulders integral with the other one of the handles and projecting inwardly from the inboard face thereof and defining a locating means for the nestable positioning of a respective operating member relative to the said other one of the handles, a pivot means extendable through the alignable pivot openings of the operating members and handles of the pair thereof with the inboard faces of one operating member and respective handle being in confrontation with the inboard faces of the other operating member and respective handle for holding the operating members and handles in interlocked relation and facilitating movement of the operating members toward each other responsively to the actuation of the handles toward each other in an operating mode, a spring means normally biasing the handles apart in a non-operating mode, the lock housing and respective one of the handles having aligned through lock openings, the lock housing having coaxial slots on opposite sides of the through lock opening, a rotative lock receivable in the through lock openings of the lock housing and respective one of the handles, and a lock pin extendable through the lock and having opposite ends engageable in the coaxial slots for the journalling of the lock about the axis of the coaxial slots and relative to the through opening in the lock housing and respective one of the handles, a pair of spaced radially disposed detents on the lock and projecting outwardly of the outboard face of the said one handle for limiting the rotative arc of the lock and allowing ready lock manipulation by an operator, the opening in the said one handle being provided with oppositely disposed bevels for defining detent bearing surfaces as the tool is moved alternately to operative and non-operative modes.

5. In the hand tool of claim 4, the detents defining a means for indicating the direction for rotating the lock to the opened or closed position.

6. In the hand tool of claim 4, including a stop means for limiting the extent of the tool opening stroke, the spring means and lock and stop means all being disposed within the confines of the operating members.

7. In the hand tool of claim 4, the lock rotatable in an arc about the lock pin axis in perpendicularity to the longitudinal axis of the pivot bolt.

8. A hand tool comprising: a pair of jaws, a pair of handles each associated with a respective jaw, each handle and respective jaw being nestably seated relative to each other, a jaw and respective handle being provided with a first self-seating feature in the form of an arcuate end face on the jaw positionable adjacent a conforming arcuate shoulder of the handle, a jaw and respective handle being provided with a second self-seating feature in the form of an inset on the jaw for allowing a snug interfitting of the jaw around the lock housing, the jaws and handles being separable as to each other and interrelated by a single pivot bolt extendable transversely through the confronted jaws and handles, a spring means biasing the jaws apart, a recessed lock housing on one of the handles defining a locating means for positioning its respective jaw in assembled position in the tool, a lock rotatably mounted in the recess of the lock housing and having spaced opposite detents alternately confrontable with opposite walls of the recess for limiting lock rotation and for locking the tool in closed position at the end of the tool closing stroke, wherein a radial line projected from the pivot bolt extends perpendicular to the longitudinal axis about which the lock rotates, stop means for limiting the tool opening stroke, the stop means and spring means and lock being located in a concealed operating area circumadjacent the pivot bolt.

9. In a hand tool of the pivoted scissors type comprising:

a pair of jaws each provided with a through pivot opening, a pair of handles each provided with a through pivot opening, a lock housing integral with one of the handles and projecting inwardly from the inboard face thereof and defining a locating means for locating a respective jaw relative to the said one of the handles with the respective pivot openings in coaxial relationship, a pair of spaced shoulders integral with the other one of the handles and projecting inwardly from the inboard face thereof and defining a locating means for locating a respective jaw relative to the said other one of the handles with the respective pivot openings in coaxial relationship, a pivot means extendable through the alignable pivot openings of the jaw and handles of the pairs thereof with the inboard faces of one jaw and respective handle being in confrontation with the inboard faces of the other jaw and respective handle for holding the jaws in interlocked relation relative to their respective handles, a spring means normally biasing the handles apart in a non-operating mode, the lock housing and respective one of the handles having aligned through lock openings, the lock housing having coaxial slots on opposite sides of the through lock opening, a lock receivable in the through lock openings of the lock housing and respective one of the handles, and a lock pin extendable through the lock and having opposite ends engageable in the coaxial slots for the rotative mounting of the lock about the axis of the coaxial slots and relative to the through opening of the lock housing.

* * * * *